United States Patent [19]

Morrison

[11] Patent Number: 4,662,164

[45] Date of Patent: May 5, 1987

[54] SEPARATION, AND PHASING OF SHEATH SLIVER AROUND A CORE

[75] Inventor: Elbert F. Morrison, Clarksville, Va.

[73] Assignee: Burlington Industries, Inc., Greensboro, N.C.

[21] Appl. No.: 813,569

[22] Filed: Dec. 26, 1985

[51] Int. Cl.[4] ..... D01H 13/04; D01H 5/72

[52] U.S. Cl. ..... 57/12; 57/210; 57/315; 19/243

[58] Field of Search ..... 57/207, 210–211, 57/224, 226–228, 3, 12, 315, 316, 317, 327, 320; 19/243, 244, 236, 258

[56] References Cited

U.S. PATENT DOCUMENTS

| | | | |
|---|---|---|---|
| 2,728,112 | 12/1955 | Berker | 57/315 |
| 2,731,789 | 1/1956 | Holder . | |
| 2,990,673 | 7/1961 | Adkins, Jr. . | |
| 3,308,615 | 3/1967 | Susskind et al. . | |
| 3,370,410 | 1/1929 | McKew et al. . | |
| 3,599,416 | 8/1971 | Reuter et al. | 57/315 |
| 3,844,098 | 10/1974 | Plate et al. | 57/315 |
| 3,844,103 | 10/1974 | Sasaki et al. . | |
| 3,913,308 | 10/1975 | Lemaire . | |
| 3,952,372 | 4/1976 | Howell | 19/243 |
| 4,307,566 | 12/1981 | Murata et al. | 57/12 |
| 4,383,403 | 5/1983 | Nakayama et al. . | |
| 4,470,254 | 9/1984 | Schultz et al. . | |
| 4,484,436 | 11/1984 | Nakayama et al. | 57/3 X |
| 4,495,761 | 1/1929 | Nakayama et al. . | |

FOREIGN PATENT DOCUMENTS

| | | |
|---|---|---|
| 5335051 | of 1976 | Japan . |
| 11775 | 3/1981 | Japan . |

*Primary Examiner*—Donald Watkins
*Attorney, Agent, or Firm*—Nixon & Vanderhye

[57] ABSTRACT

A novel roving, and spun yarn produced from the roving, have a core and a sheath arrangement with substantially 100 percent of a first type of fiber in the sheath, and for a second type of fiber having distinctly different properties than the first fiber, about 75–90 percent in the core and about 25–10 percent in the sheath. Yarns having a cheaper fiber in the center (e.g. polyester) and a more expensive fiber on the outside (e.g. wool), or one having a higher strength core fiber and a more luxurious sheath fiber, can be produced. A sliver of first fibers and a distinct sliver of second fibers are fed in generally parallel paths. The slivers are continuously drafted to produce two distinct drafted slivers, and the path of at least one of the drafted slivers is changed so that the two slivers proceed in intersecting paths, and at substantially the same speed. The first fibers are continuously caused to wrap around the second fibers, with an angle of intersection between the two paths in the range of 60°–120°, to produce a composite drafted sliver-roving, which is twisted to produce a roving. The roving is ring spun to produce a spun yarn with about 75–90 percent of the second fibers in the core and about 25–10 percent in the sheath, and substantially 100 percent of the first fibers in the sheath.

28 Claims, 9 Drawing Figures

Fig. 3
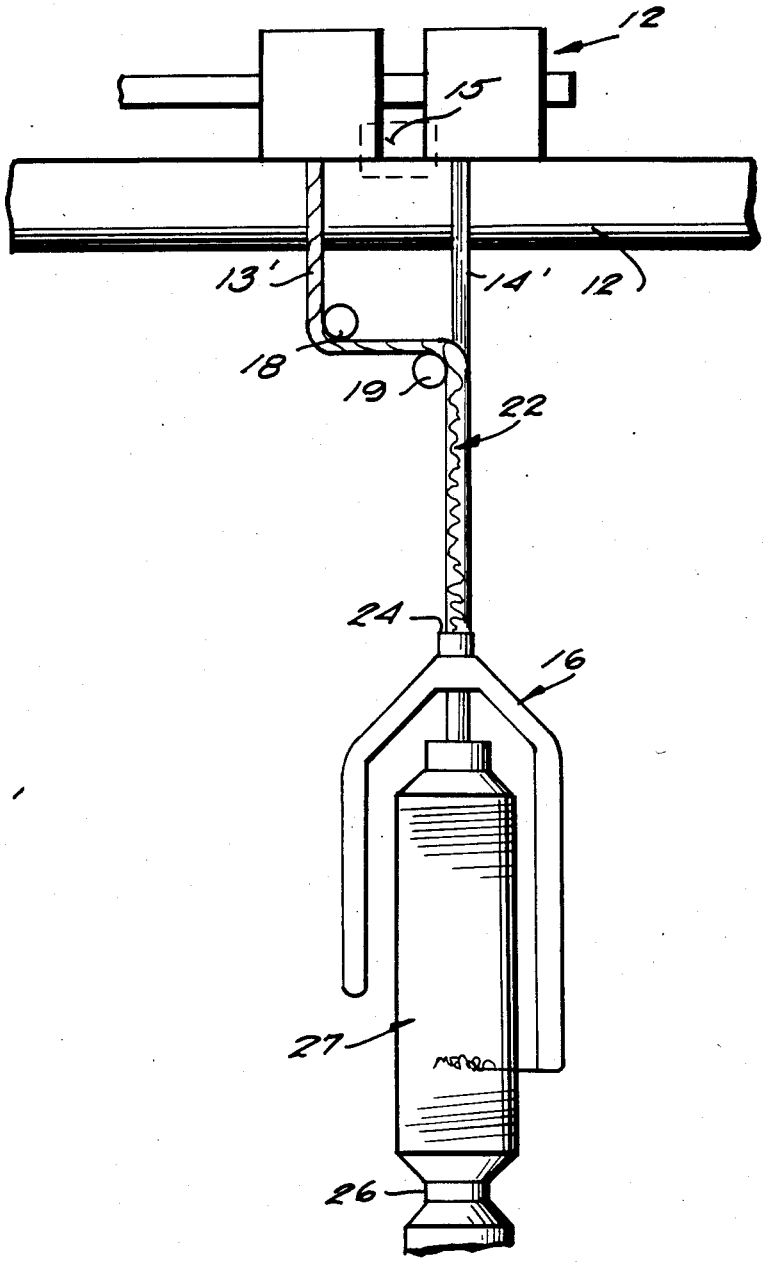
Fig. 4
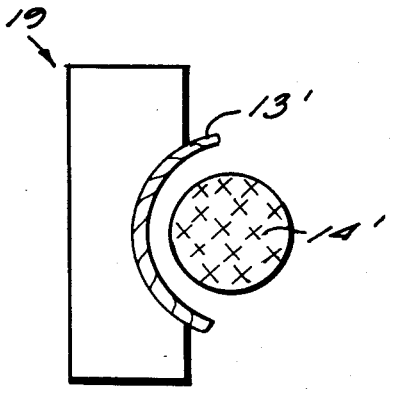
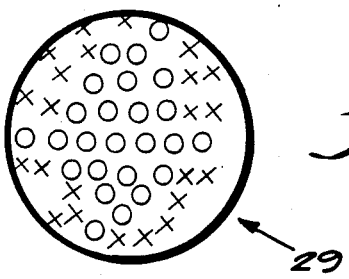
Fig. 7

SEPARATION, AND PHASING OF SHEATH SLIVER AROUND A CORE

BACKGROUND AND SUMMARY OF THE INVENTION

In the manufacture of many different textile products, it is desirable to be able to produce yarns having a great deal of diversity. It is also desirable to be able to utilize yarns that have the least cost possible while still having desirable aesthetic and other properties to produce fabrics having good hand and appearance.

In the past there have been a number of different attempts to produce yarns composed of more than one different fiber so that the yarn will have a distinctive appearance, such as provided by U.S. Pat. No. 4,383,403. Additionally, there have been attempts to produce multiple layered spun yarns having different properties between a core and a sheath so that desirable properties of two different types of fibers may be utilized to produce a composite spun yarn having most of the desirable properties of both. One such procedure is shown in Japanese patent publication No. 11775, and is commonly referred to as the Palpa process. While the yarns produced by the process do have a number of significant advantages, they sometimes tend to be more uneven than desired so that there is not complete uniformity of coverage of the core fibers by the sheath fibers.

According to the present invention, an advantageous spun yarn is produced that has a uniform core and sheath construction, the sheath surrounding the core. The yarn is formed from two different fibers, which fibers have distinctly different properties, and the yarn produced according to the invention has very desirable evenness of coverage, and is extremely versatile, being utilizable to produce yarns, and resulting fabrics, having distinctive appearances, as well as having most of the desirable properties from both of the fibers.

According to one aspect of the present invention, a method is provided for producing a roving having a first fiber substantially covering a second fiber. The roving is produced by the following steps: (a) A sliver of first fibers and a sliver of second fibers, which have clearly distinctive properties from the first fibers, are fed in generally parallel paths. (b) The slivers are continously drafted to produce two drafted slivers. (c) The path of at least one of the drafted slivers is changed so that the drafted slivers proceed in intersecting paths, and at substantially the same speed. Preferably the second drafted sliver moves in a continuous straight line, while the path of the first drafted sliver is diverted to intersect the path of the second sliver. (d) The fibers of the first drafted sliver are caused to wrap around the fibers of the second drafted sliver, with an angle of intersection between the two paths of slivers in the range of 60°–120° (preferably about 90°) to produce a composite drafted sliver-roving. And, (e) the composite sliver-roving is twisted (e.g. by a mechanical roving flyer frame) into a roving having the majority of the second fibers in a core, and the majority of the first fibers in a sheath surrounding the core.

The invention also comprises a method of producing a spun yarn from the roving set forth above, by spinning (e.g. mechanically spinning on a spinning frame) the composite roving to produce a spun yarn with the sheath and core. In the final yarn produced, about 75–90 percent of the second fibers are in the core and about 25–10 percent in the sheath, while substantially 100 percent of the first fibers are in the sheath.

The yarn produced according to the invention has numerous potential desirable characteristics, and the method is versatile so as to produce a wide variety of different yarns. For example, by putting a less expensive fiber in the center and a more expensive or desirable fiber on the outside for better aesthetics and fabric performance, desirable yarns (and resulting fabrics) can be produced less expensively. For instance, the yarn according to the present invention may have a core of polyester, and a sheath of wool, the percentage of polyester to wool in the final yarn being about 40–60 percent/60–40 percent. Alternatively, a yarn can be produced that has a high strength fiber as the core and a more luxurious fiber on the outside, and/or the yarn can be produced wherein the different fibers have distinctly different colors and/or dyeability properties, resulting in a very distinctive looking yarn and resulting fabric.

It is the primary object of the present invention to provide a method and apparatus of producing, and to produce, a yarn with a core and a sheath and composed of different fibers having distinctly different characteristics. This and other objects of the invention will become clear from an inspection of the detailed description of the invention and from the appended claims.

BRIEF DESCRIPTION OF THE DRAWINGS

FIG. 3 is a front view of the apparatus shown in FIG. 1, and also showing the spinning components, and the like, for producing a roving according to the invention;

FIG. 4 is a schematic detail view showing one of the guide components of the apparatus of FIG. 3;

FIG. 7 is a diagrammatic cross-sectional view of spun yarn according to the invention.

DETAILED DESCRIPTION OF THE DRAWINGS

Figure 1:
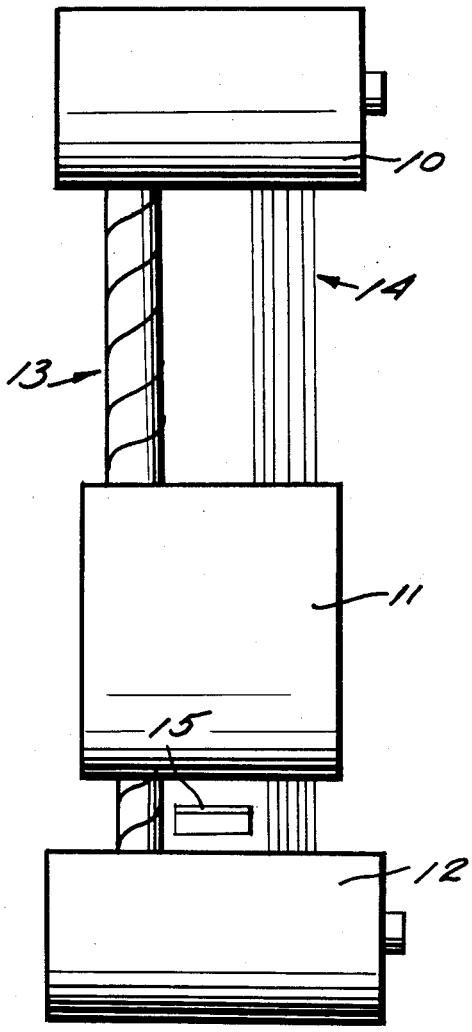
FIG. 1 is a top schematic view of exemplary apparatus for producing an exemplary roving according to the present invention.
Figure 2:
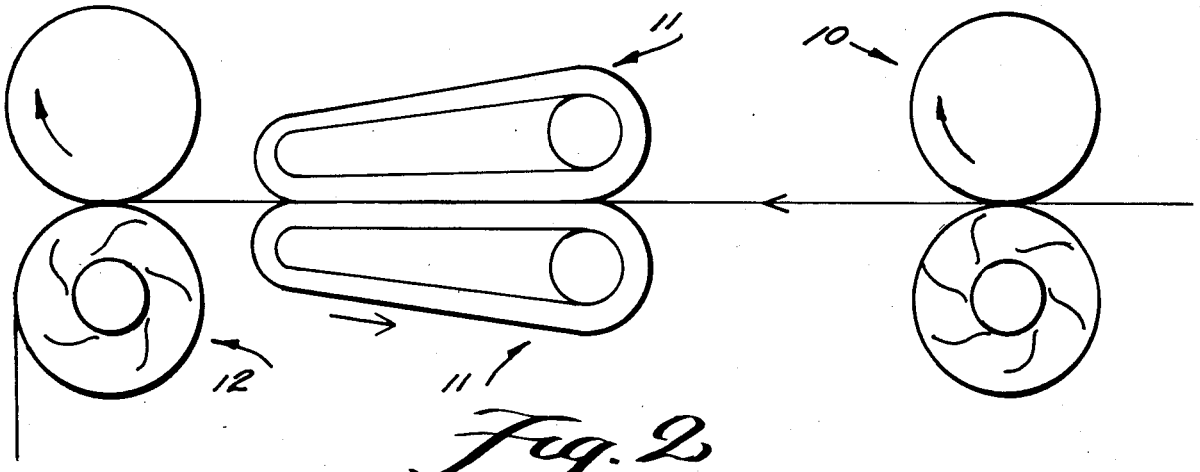
FIG. 2 is a side view of the apparatus shown in FIG. 1.

The basic apparatus useful in practicing the method according to the present invention, comprises basically standard components. In particular, the apparatus includes a drafting zone, as illustrated in FIG. 1, having as conventional components thereof a back roll 10, an apron 11, and a front roll 12. Two distinctive slivers are fed to the drafting system in generally parallel, and distinctive, paths. The first sliver 13 is composed of first fibers, and the second sliver 14 is composed of second fibers having distinctly different properties than the first fibers. In one typical example, the fibers of the sliver 13 would be wool, while the second fibers of the second sliver 14 would be polyester (e.g. Dacron). The slivers may have a wide variety of weights, one exemplary desirable weight being 40 grams per yard. According to the invention, a spacer 15 is provided between the apron 11 and front roll 12 to ensure that the slivers 13, 14 are maintained in distinctive paths.

After passing through the front rolls 12, the drafted slivers, indicated by reference numerals 13′ and 14′ in FIG. 3, are moved, preferably downwardly, toward a roving flyer device, such as a conventional roving flyer frame 16. The slivers 13′, 14′ move at substantially the same speed. The front rolls 12 may have a discontinuity therein, as seen in FIG. 3, but it is important that the drafted slivers 13′, 14′ have substantially the same speed.

After exiting the rollers 12, the path of at least one of the slivers is changed so that the paths are no longer parallel, as they were in passing through the apparatus 10, 11, 12. This is preferably accomplished by allowing the second drafted sliver 14′ to continue in a linear path (although now preferably moving downwardly) after it exits rollers 12, and diverting the path of the first sliver 13′. Diversion of the path is accomplished by passing the first sliver 13′ around a first guide element 18, and then around a second guide member 19. At the second guide member 19, the path of the first drafted sliver 13′ makes an angle with respect to the path of the first sliver 14′ in the range of 60°–120°, the intersecting paths preferably being at about 90°, as illustrated in FIG. 3. At the point of intersection of the paths, as seen schematically in FIG. 4, the second guide 19 causes the fibers of the first sliver 13′ to wrap around the fibers of the second sliver 14′. At the point of wrap, the fibers of the first sliver 13′ will essentially have no twist, while the fibers of the second sliver 14′ will have essentially full twist.

The composite sliver-roving 22 (see FIG. 3) comprises a drafted sliver-roving having a majority of the second fibers 14′ in a core, and a majority of the first fibers 13′ in a sheath surrounding the core.

The composite drafted sliver-roving 22 is passed, without significant additional processing, to the roving flyer frame 16. The conventional flyer frame 16 may have at the top 24 thereof a false twist navel, which adds twist to the sheath (e.g. wool) yarns. The roving is taken up on bobbin 26, and is illustrated generally by reference numeral 27. One exemplary form of roving 27 according to the present invention may be seen in FIG. 5, the yarn 29 illustrated in FIG. 6 having been produced from the composite drafted roving 22 of FIG. 5.

Figure 5:
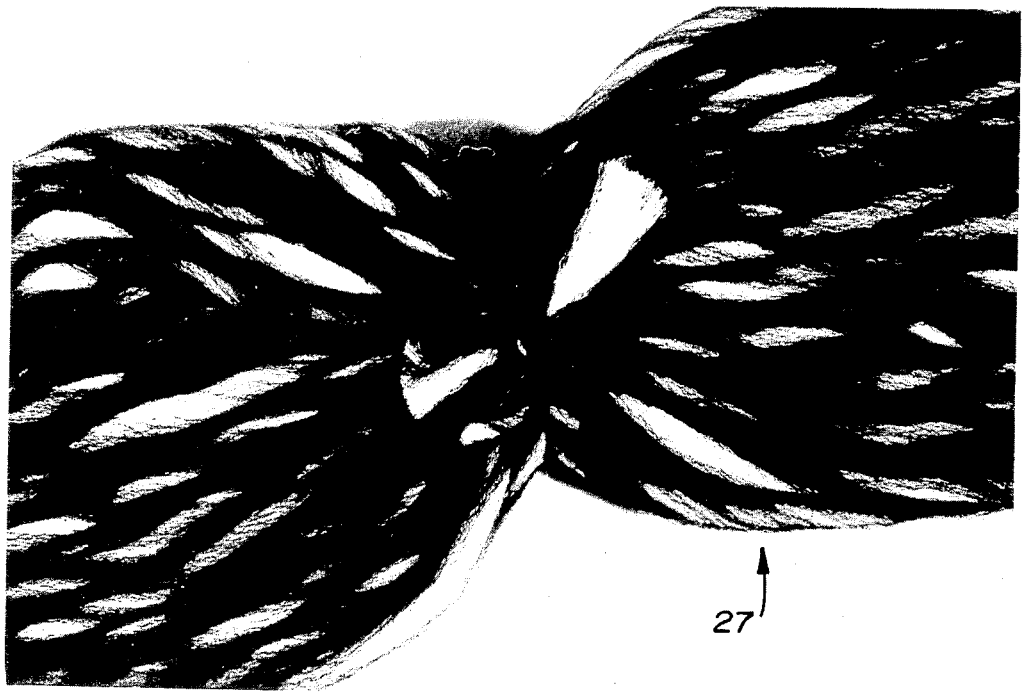
FIG. 5 is a photograph of a distinctive roving produced according to the present invention with one set of fibers natural color and the other dyed black.

The roving of FIG. 5 has been produced from 55 percent 3 denier polyester yarn having a natural color, and 45 percent 64's stock wool yarn dyed black. From an inspection FIG. 5 it will be seen that while some white areas can be seen from the exterior, the majority of the exterior appears to be black, meaning that the core is mostly polyester while the sheath is mostly wool. In fact, the roving 27 typically would have about 75–90 percent of the second fibers (polyester in the exemplary embodiment illustrated) in the core, and 25–10 percent in the sheath, while substantially 100 percent of the first fibers (wool in the illustrated embodiment) in the sheath.

Figure 6:
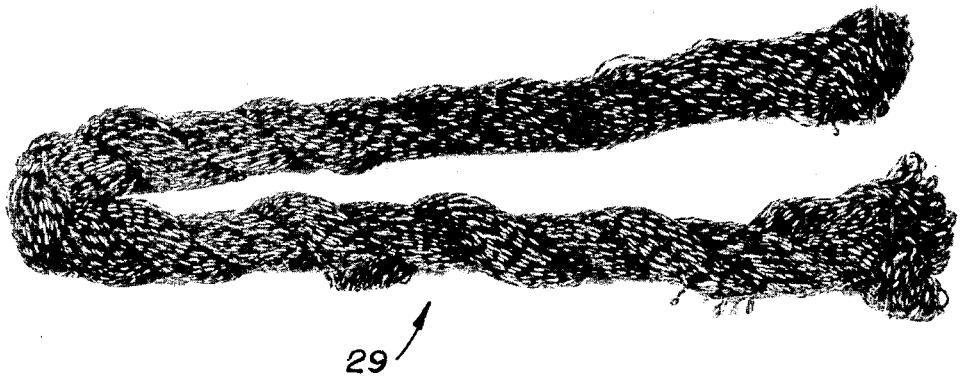
FIG. 6 is a photograph of a yarn produced from the roving of FIG. 5.

The roving 27 is formed into yarn by again drafting it, in conventional drafting apparatus (not shown), and then inserting twist on a conventional ring spinning frame. A spun yarn is produced. FIG. 7 provides a schematic representation of a yarn 29, the polyester being schematically illustrated by circles, and the wool being schematically illustrated by "x"s. FIG. 6 is a photograph of exemplary yarn 29. Note the distinctive appearance of the yarn, too, including the fact that while some white can be seen on the exterior, the majority of the exterior is black. The yarn 29 has the same proportions of fibers in the sheath and core as the roving 27.

Figure 8:
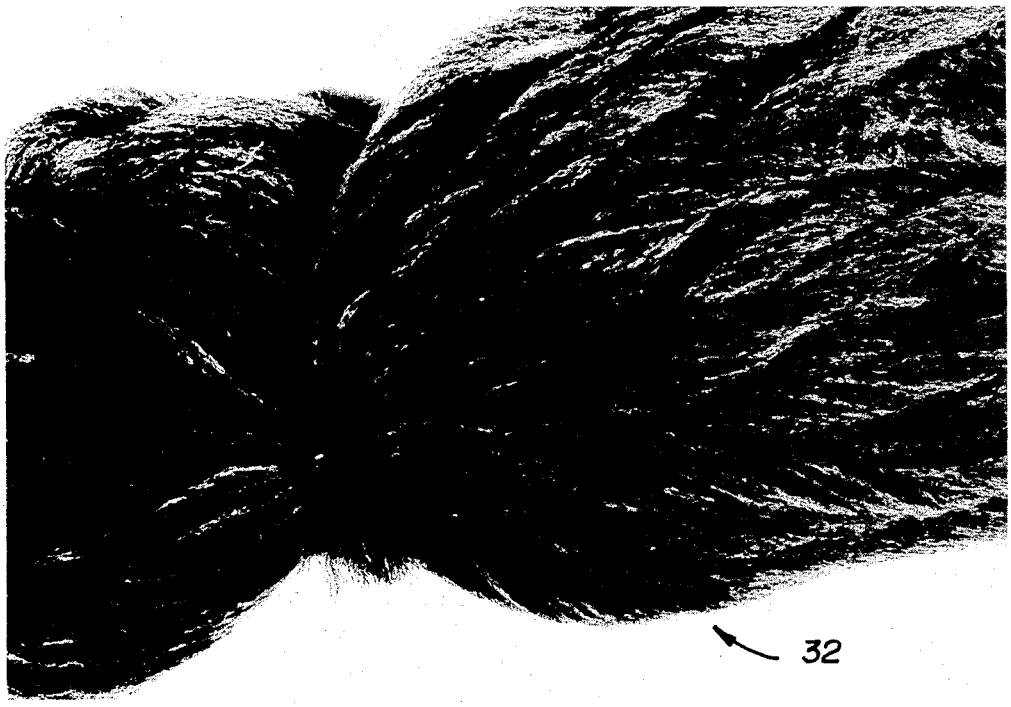
FIGS. 8 and 9 are photographs of standard worsted blended roving (FIG. 8) and yarn (FIG. 9) produced from the same percentage of fibers as the roving and yarn of FIGS. 5 and 6.
Figure 9:
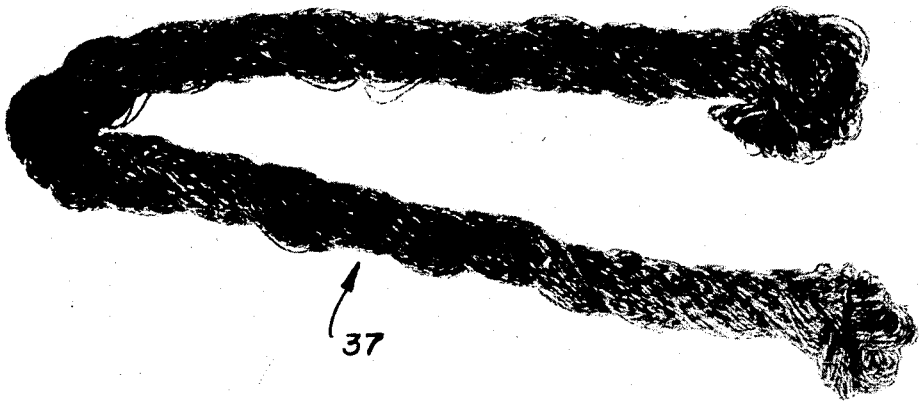

The distinctiveness of the roving and yarn produced according to the present invention may be seen by comparison of FIGS. 5 and 6 with FIGS. 8 and 9, respectively. The roving 32 of FIG. 8 was made of exactly the same fibers, and ratio of fibers, as the roving 27 of FIG. 5, only it was made by a standard worsted blended process where the fibers were intimately blended and mixed uniformly. The yarn 37 of FIG. 9 was made from roving 32. As can be seen, both the composite roving 32 and yarn 37 have basically even tones, and a gray color, as compared to the roving 27 and yarn 29.

The yarn 29 according to the present invention is particularly desirable when about 40–60 percent of the fibers are polyester, and about 60–40 percent are wool. For instance blends of 50 percent polyester and 50 percent wool, and 55 percent polyester and 45 percent wool (as actually used in the construction of the yarn 29) are desirable. However it is to be understood that the invention is not limited merely to the utilization of polyester and wool, but a wide variety of other fibers may be employed. For example the sheath fibers may be wool, long staple synthetic fibers such as long staple polyester, and even short staple fibers such as cotton, depending upon the qualities of the end product desired. The core fibers also can have a wide variety of different staple lengths and be of a wide variety of materials. For instance where as higher strength fiber is desired in the core and a more luxurious fiber on the outside, the core can be of nylon, aramid, or super strength polyethylene fiber, while the sheath will contain primarily cotton, wool, or long staple polyester fibers. If an unusual aesthetic effect is desired, the first and second fibers can be of different color, or have different dyeability properties, an exemplary distinctive effect that can be obtained in that manner being readily apparent from the roving 27 of FIG. 5, and the yarn 29 of FIG. 6.

It will thus be seen that according to the present invention a highly desirable spun yarn having a core and a sheath surrounding the core, and formed of first and second fibers having distinctive properties, can be produced. The invention contemplates a simple yet effective method for producing such a yarn, and a simple yet effective apparatus for practicing the method.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent products, methods, and apparatus.

What is claimed is:

1. A method of producing a roving having a first fiber substantially covering a second fiber, comprising the steps of:

(a) feeding a sliver composed of first fibers, and a sliver composed of second fibers having clearly distinctive properties from the first fibers, in generally parallel paths;

continuously drafting the generally parallel first and second slivers to produce two distinct drafted slivers;

(c) changing the path of at least one of the drafted slivers so that the drafted slivers proceed in intersecting paths and at substantially the same speed;

(d) continuously causing the first fiber drafted sliver to wrap around the second fiber drafted sliver while causing the paths of the slivers to intersect at an angle within the range of 60°–120°, to produce a composite drafted roving; and (e) twisting the composite drafted roving to produce a roving having the majority of the second fibers thereof in a core, and the majority of the first fibers thereof in a sheath surrounding the core.

2. A method as recited in claim 1 wherein step (d) is practiced so that about 75–90 percent of the second fibers are in the core of the composite drafted sliver, and about 25–10 percent in the sheath, while substantially 100 percent of the first fibers are in the sheath.

3. A method as recited in claim 2 wherein the second fibers are fibers that are less expensive, and have poorer aesthetic properties than the first fibers.

4. A method as recited in claim 3 wherein the first fibers are wool, and the second fibers are polyester.

5. A method as recited in claim 2 wherein the second fibers are stronger than the first fibers, and wherein the first fibers are more luxurious than the second fibers.

6. A method as recited in claim 1 wherein the first and second fibers are of different color or different dyeability properties.

7. A method as recited in claim 1 wherein the angle of intersection between the two paths at wrapping is about 90°.

8. A method of producing a spun yarn having a sheath primarily of a first fiber, and a core primarily of a second fiber, comprising the steps:

(a) feeding a sliver composed of first fibers, and a sliver composed of second fibers having clearly distinctive properties from the first fibers, in generally parallel paths;

(b) continuously drafting the generally parallel first and second slivers to produce two distinct drafted slivers;

(c) changing the path of at least one of the drafted slivers so that the drafted slivers proceed in intersecting paths and at substantially the same speed;

(d) continuously causing the first fiber drafted sliver to wrap around the second fiber drafted sliver, at an angle of intersection between the two paths in the range of 60°–120°, to produce a composite drafted sliver-roving;

(e) twisting the composite drafted sliver-roving to produce a roving; and (f) spinning the roving to produce a spun yarn having a core primarily of second fibers, and a sheath primarily of first fibers.

9. A method as recited in claim 8 wherein step (f) is practiced by ring spinning.

10. A method as recited in claim 9 wherein step (d) is practiced so that the angle of intersection between the two paths at wrapping is about 90°.

11. A method as recited in claim 9 wherein the steps are practiced so that about 75–90 percent of the second fibers are in the core of the spun yarn, and about 25–10 percent in the sheath, while substantially 100 percent of the first fibers are in the sheath.

12. A method as recited in claim 8 wherein the steps are practiced so that about 75–90 percent of the second fibers are in the core of the spun yarn, and about 25–10 percent in the sheath, while substantially 100 percent of the first fibers are in the sheath.

13. A method as recited in claim 12 wherein steps (a)–(e) are practiced so that the roving has about 75–90 percent of the second fibers in the core, and about 25–10 percent in the sheath, and substantially 100 percent of the first fibers in the sheath.

14. A method as recited in claim 12 wherein the second fibers are fibers that are less expensive, and have poorer aesthetic properties than the first fibers.

15. A method as recited in claim 14 wherein the first fibers are wool, and the second fibers are polyester.

16. A method as recited in claim 12 wherein the second fibers are stronger than the first fibers, and wherein the first fibers are more luxurious than the second fibers.

17. A spun yarn comprising a uniform core and sheath construction, the sheath surrounding the core, the yarn being formed of first and second fibers having distinctly different properites than each other, and produced by the steps of:

(a) feeding a sliver composed of first fibers, and a sliver composed of second fibers having clearly distinctive properties from the first fibers, in generally parallel paths;

(b) continuously drafting the generally parallel first and second slivers to produce two distinct drafted slivers;

(c) changing the path of at least one of the drafted slivers so that the drafted slivers proceed in intersecting paths and at substantially the same speed;

(d) continuously causing the first fiber drafted sliver to wrap around the second fiber drafted sliver, at an angle of intersection between the two paths in the range of 60°–120°, to produce a composite drafted sliver-roving;

(e) twisting the composite sliver-roving to produce a roving; and (f) spinning the roving to produce a spun yarn having a core primarily of second fibers, and a sheath primarily of first fibers.

18. A spun yarn as recited in claim 17 wherein about 75–90 percent of the second fibers are in the core, and about 25–10 percent are in the sheath, and substantially 100 percent of the first fibers are in the sheath.

19. A spun yarn comprising a uniform core and sheath construction, the sheath surrounding the core, and the yarn formed of first and second fibers having distinctly different properties, and wherein: about 75–90 percent of said second fibers are in said core, and about 25–10 percent in said sheath; and about 100 percent of said first fibers are in said sheath.

20. A yarn as recited in claim 19 wherein said second fibers are less expensive, and have poorer aesthetic properties than, said first fibers.

21. A yarn as recited in claim 20 wherein said first fibers are wool, and said second fibers are polyester.

22. A yarn as recited in claim 19 wherein said second fibers are stronger than said first fibers, and said first fibers are more luxurious than said second fibers.

23. A yarn as recited in claim 19 wherein said first and second fibers have distinctly different colors or dyeability properties.

24. A method as recited in claim 1 wherein step (d) is practiced by causing the second drafted sliver to move in substantially a straight line after drafting, and causing the first sliver to be diverted into a path making an angle in the range of 60°–120° from the straight line path of the second sliver.

25. A method as recited in claim 9 wherein step (d) is practiced by causing the second drafted sliver to move in substantially a straight line after drafting, and causing the first sliver to be diverted into a path making an angle in the range of 60°–120° from the straight line path of the second sliver.

26. Apparatus for producing a roving from drafted sliver having a first fiber substantially covering a second fiber, comprising:

drafting apparatus including a rear set of rolls, an apron, and a front set of rolls, the front set of rolls elongated in a dimension parallel to the axis of rotation thereof;

a spacer element disposed between the apron and the front set of rolls at a position intermediate the front rolls along the dimension of elongation thereof, so as to separate two distinctive slivers passing through said rear rolls, apron, and front rolls; and first and second guide elements mounted in a position spaced from said front rolls, said guide elements for diverting the path of one sliver exiting said front rolls so that it intersects the path of a second silver exiting said front rolls, and makes an angle therewith in the range of 60°–120°; and a roving flyer frame mounted on the opposite side of said guide elements from said front rolls.

27. Apparatus as recited in claim 26 wherein said first guide element comprises a guide means for diverting the path of a first sliver about 90° with respect to its path when exiting the front rolls, and wherein the second guide element comprises guide means for facilitating wrapping of fibers of the first sliver around fibers of the second sliver.

28. Apparatus as recited in claim 27 wherein said roving flyer frame includes a false twist navel.

* * * * *